US006497295B1

(12) United States Patent
Carmichael et al.

(10) Patent No.: US 6,497,295 B1
(45) Date of Patent: Dec. 24, 2002

(54) TORQUE LIMITING TOOL

(75) Inventors: Mark Carmichael, Jersey (GB); Paul Howlett, Aberdeen (GB)

(73) Assignee: Specialised Petroleum Services Limited, Westill (GB)

( * ) Notice: Subject to any disclaimer, the term of this patent is extended or adjusted under 35 U.S.C. 154(b) by 0 days.

(21) Appl. No.: 09/494,760

(22) Filed: Jan. 31, 2000

(30) Foreign Application Priority Data

Jan. 31, 1999 (GB) ..... 9902027

(51) Int. Cl.[7] ..... E21B 17/06

(52) U.S. Cl. ..... 175/48; 166/317; 175/317; 175/324; 285/2

(58) Field of Search ..... 175/324, 317, 175/40, 48; 285/2, 3; 166/317

(56) References Cited

U.S. PATENT DOCUMENTS

| | | | | |
|---|---|---|---|---|
| 1,414,207 A | | 4/1922 | Reed | |
| 1,610,414 A | | 12/1926 | Bernard et al. | |
| 1,839,690 A | * | 1/1932 | Malinowski | 285/2 |
| 1,923,132 A | | 8/1933 | Witkin | |
| 2,500,276 A | * | 3/1950 | Church | 285/2 |
| 2,988,145 A | * | 6/1961 | Clark, Jr. | 175/317 |
| 3,371,729 A | * | 3/1968 | Carr | 175/293 |
| 3,727,948 A | * | 4/1973 | Current | 285/3 |
| 3,939,670 A | * | 2/1976 | Amtsberg | 464/20 |
| 4,064,953 A | | 12/1977 | Collins | 175/321 |
| 4,452,472 A | * | 6/1984 | Crase | 285/3 |

* cited by examiner

*Primary Examiner*—Hoang Dang
(74) *Attorney, Agent, or Firm*—Fleshner & Kim, LLP

(57) ABSTRACT

A down-hole tool comprises a generally tubular body for connection in a drill string, the body typically having an upper tubular member and a lower tubular member interconnected to be axially secured and relatively rotatable, and a frangible element securing the upper and lower members together rotationally and adapted to rupture at a predetermined load

13 Claims, 3 Drawing Sheets

TORQUE LIMITING TOOL

BACKGROUND OF THE INVENTION

This invention relates to a downhole tool for use in a drill string to prevent breakage of the drill string by over torquing.

When rotating drill strings in wells, the lower drill string outside diameter may be typically only about 50 to 100 millimeters. If the drill bit becomes stuck in the hole this is not immediately apparent to the operator who will continue applying torque at the drilling derrick. This can lead to breakage of the drill string deep in the hole which requires a long and expensive fishing operation to retrieve.

SUMMARY OF THE INVENTION

The present invention provides a downhole tool comprising a generally tubular body for connection in a drill string, the body comprising an upper tubular member and a lower tubular member interconnected to be axially secured and relatively rotatable, and a frangible element securing the upper and lower members together rotationally and adapted to rupture at a predetermined load.

Preferably, the tool further includes signalling means for signalling to an operator that the frangible element has been ruptured.

The signalling means may generate a signal to the operator in the form of any one or more of the following group; change in torque, change in weight, change in pressure, mud pulse.

The tool may comprise a substantially radial passage allowing for the circulation of fluid from an axial bore through the tool to the exterior of the tool when the frangible element has been ruptured.

The effect of this arrangement is that, if excessive torque is applied to the drill string as a result of for example the drill bit sticking, the frangible element ruptures to uncouple the upper and lower members rotationally. The rupture also opens the passage to allow drilling fluid to flow into the annulus bypassing the drill bit. The bypass of drilling fluid alerts the operator to the incident by virtue of the significantly reduced drilling fluid pressure.

The tool may include means for re-establishing drilling fluid flow through the drill bit after the frangible element has been ruptured, thereby assisting in removing the drill string by continuing the removal of cuttings from the annulus.

In one arrangement, the lower part of the upper tubular member is of reduced diameter and is encircled by the lower tubular member, said passage being formed by radial bores in the overlapping parts of the upper and lower tubular members. Preferably a plurality of passages are provided, typically three or four passages circumferentially equispaced, each having a frangible element in the form of a shear plug.

The tool may include a valve member moveable from a first position permitting fluid flow through the passage to a second position obturating the passage.

The valve member is typically a cylindrical sleeve mounted in the bore of the upper tubular member for sliding movement. The cylindrical sleeve may be secured in its first position by a shear pin, or by a spring-loaded detent or a friction element. The second position of the sleeve may conveniently be defined by abutment surfaces on the sleeve and tubular member.

In one embodiment, the cylindrical sleeve is movable from. its first position to its second position by a ball passed down the drill string bore seating in the sleeve. In a particularly preferred form, the sleeve has axially spaced apertures, upper apertures being aligned with the passages in the first position and lower apertures communicating with the bore of the lower tubular member in the second position, and the ball is an extrudable ball.

The invention encompasses other forms of valve member and operation; or example the valve member could be actuated to its second position by a wireline operation or by signalling, such as mud pulse signalling, to a control circuit within the tool.

The passage may be formed in both the upper tubular member and the lower tubular member, whereby communication between the axial bore of the tool and the exterior of the tool occurs by aligning the respective upper and lower members appropriately.

DESCRIPTION OF THE DRAWINGS

Embodiments of the present invention will now be described, by way of example only, with reference to the accompanying drawings, in which.

DETAILED DESCRIPTION OF PREFERRED EMBODIMENTS

Figure 1:
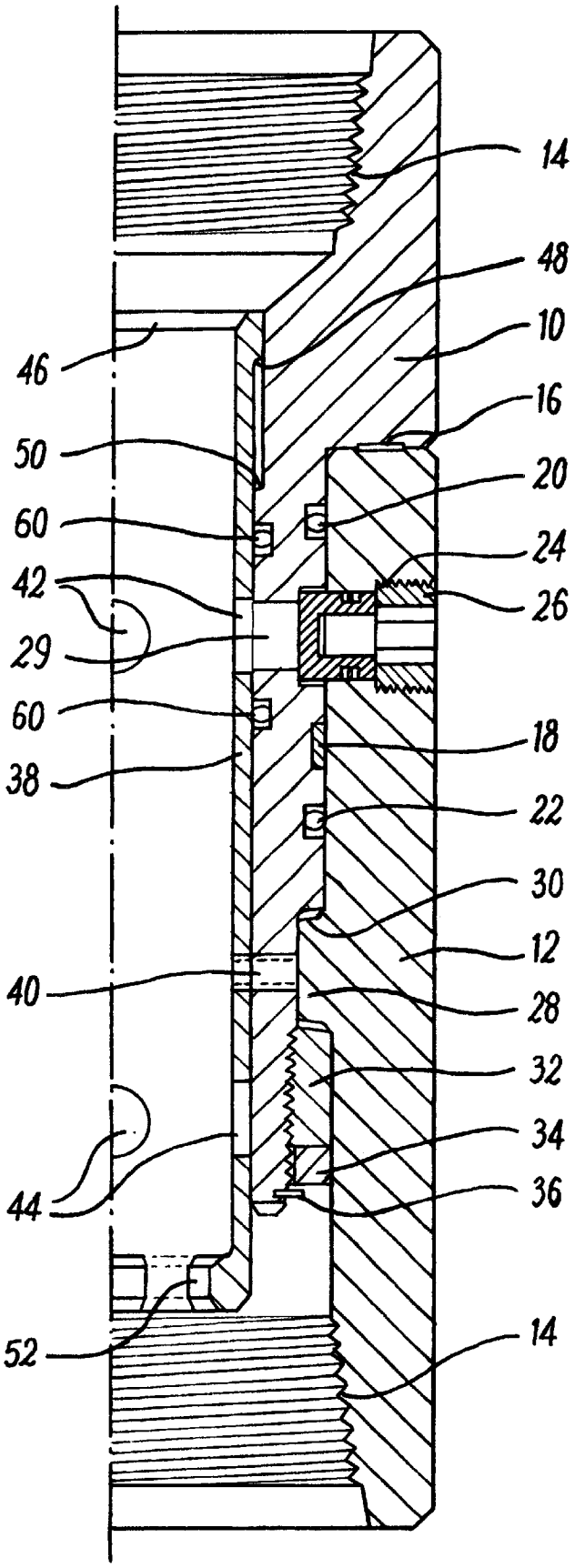
FIG. 1 is a cross-sectional side view of one half of a downhole tool embodying the invention.

Referring firstly to FIG. 1, the tool has a tool body formed by an upper tubular member 10 and a lower tubular member 12. Each of the tubular members 10 and 12 is provided with a screw threaded box section 14 for connection in a drill string.

The tubular members 10 and 12 are relatively rotatable and are provided with bearing rings 16 and 18 and sealing rings 20 and 22 to accommodate such rotation. Rotation is normally prevented by means of one or more shear plugs 24. The or each shear plug 24 is mounted in co-operating apertures in the upper and lower tubular members 10 and 12 and secured in place by an apertured threaded plug 26 so as to close an aperture 29 extending radially from the central bore of the tool.

The upper and lower tubular members 10, 12 are secured together axially by means of an annular rib 28 engaging against a shoulder 30 and a screw threaded ring 32 secured in place by a lock ring 34 and a cir-clip 36.

A cylindrical sleeve 38 is slidably mounted in the inner bore of the upper tubular member 10 and is initially secured in the position shown in the drawing by a shear pin 40. The sleeve 38 is provided with upper ports 42 and lower ports 44, and in the initial position shown the upper ports 42 are in registry with the passages 29 while the lower ports 44 are obturated by a section of the upper tubular member 10. Seals 60 are provided between the sleeve 38 and the upper tubular member 10 in the vicinity of the passages 29.

In use, the tool is included in the lower part of the drill string and drilling is conducted in the normal way, the drilling fluid passing through the drill string including the tool. If the drill bit becomes stuck in the hole, an excessive torque is developed across the tool which causes shearing of the shear plug or plugs 24. This permits drill fluid to pass from the bore to the annulus via one or more passages 29, resulting in a significant drop in drilling fluid pressure and thus alerting the operator to the occurrence. The shearing of the plug or plugs 24 also allows the upper tubular member 10 and the drill string above it to rotate freely until the drive is discounted, thus avoiding further damage.

The tool of the present invention allows the operator to re-establish drilling fluid circulation to the drill bit and therefore up the annulus from the bottom of the hole. In the present embodiment, an extrudable rubber ball is inserted in the flow of drilling fluid and is passed down the bore of the drill string until it engages a ball seat 46 formed at the upper end of the sleeve 38. In this position, the ball and therefore the sleeve 38 are forced downwardly breaking the shear pin 40 and causing the sleeve 38 to move downwardly until an external shoulder 48 at the top of the sleeve 38 engages against an internal [should] shoulder 50 in the tubular member 10. Thereafter the drilling fluid pressure causes the ball to be extruded through the seat 46 and to travel along the length of the sleeve 38 until it is engaged by shoulders 52 at the foot of the sleeve 38. In this condition, the upper apertures 42 are obturated by the wall of the upper tubular member 10, while the lower apertures 44 are open to provide communication of drilling fluid to the foot of the drill string via the bore of the lower tubular member 12.

This permits the re-establishment of drilling fluid circulation throughout the drill string and annulus, thus removing drilling cuttings and other debris and simplifying the removal of the drill string from the hole.

In an alternative embodiment, the sleeve 38 may be movable to a third position at which both the lower and upper apertures 42, 44 are obturated, allowing the ball on seat 52 to be pressured up and forced further down the drill to serve additional functions.

Figure 2:
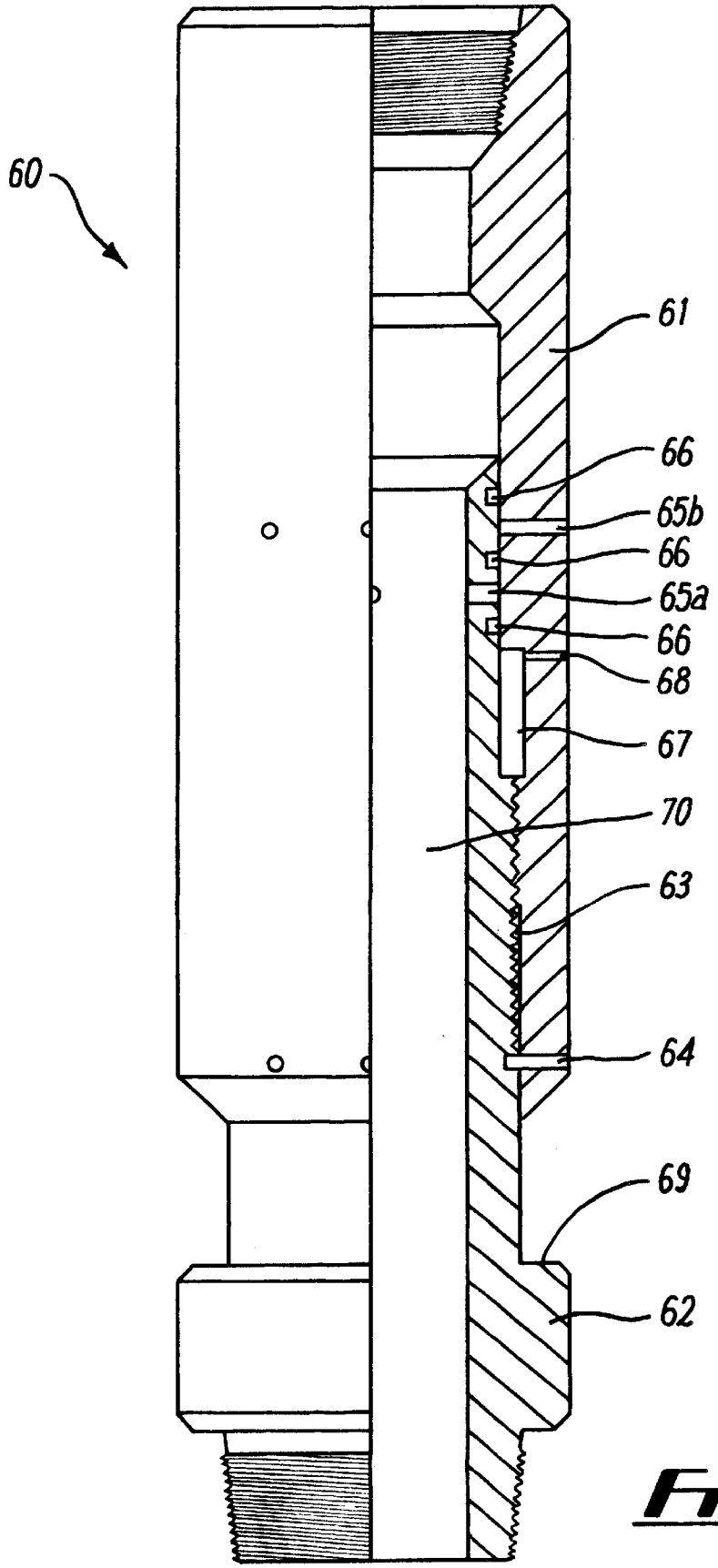
FIG. 2 is a also a cross-sectional side view, but of an alternative tool embodying the invention.

An improved tool, generally depicted at 60, is shown in FIG. 2. Again the tool 60 comprises an upper tubular member 61 and a lower tubular member 62. The two members 61, 62 are axially secured by their threaded portions at 63.

A frangible element in the form of a shear pin 64 rotatably couples the two tubular members 61,62 together.

A passage 65, formed in two parts, extends axially through the walls of the upper tubular member 65*a* and lower tubular member 65*b*, subject to the alignment of the two tubular members. Bearings 66 seal the passage portions 65*a*,65*b* preventing flow through the passage 65 when the portions are not aligned.

A grease reservoir 67 and expulsion port 68 is provided above the thread 63 for lubrication purposes.

In normal use, the tool 60 adopts the position shown in FIG. 2. When a predetermined torque is exceeded, the pins 64 shear leaving the upper tubular member free to rotate relative to the lower tubular member 62. Accordingly, the upper member 61 rotates on the thread 63 and moves down relative to the lower member 62 until the respective portions of the passage 65 are aligned.

Drill fluid is then able to circulate out of the bore 70 through the passage 65 resulting in a significant pressure drop easily detectable from surface.

In the event that the obstruction or other problem giving rise to an excessive torque being reached can be removed or mitigated, the rotational coupling of the members 61,62 can be regained by allowing the continued rotation of the upper member 61 down the thread 63 on the lower member 62 until the upper member 61 lands on the shoulder 69 integral with the lower member 62.

At this point the members 61,62 remain threadably engaged, but the upper member can no longer move downwardly relative to the lower member and thus mutual rotation occurs.

Circulation through the tool is also re-established as respective portions of the passage 65 revert to an out of alignment state.

If needed, left hand rotation can be used to lift the upper member relative to the lower member for some applications.

Figure 3:
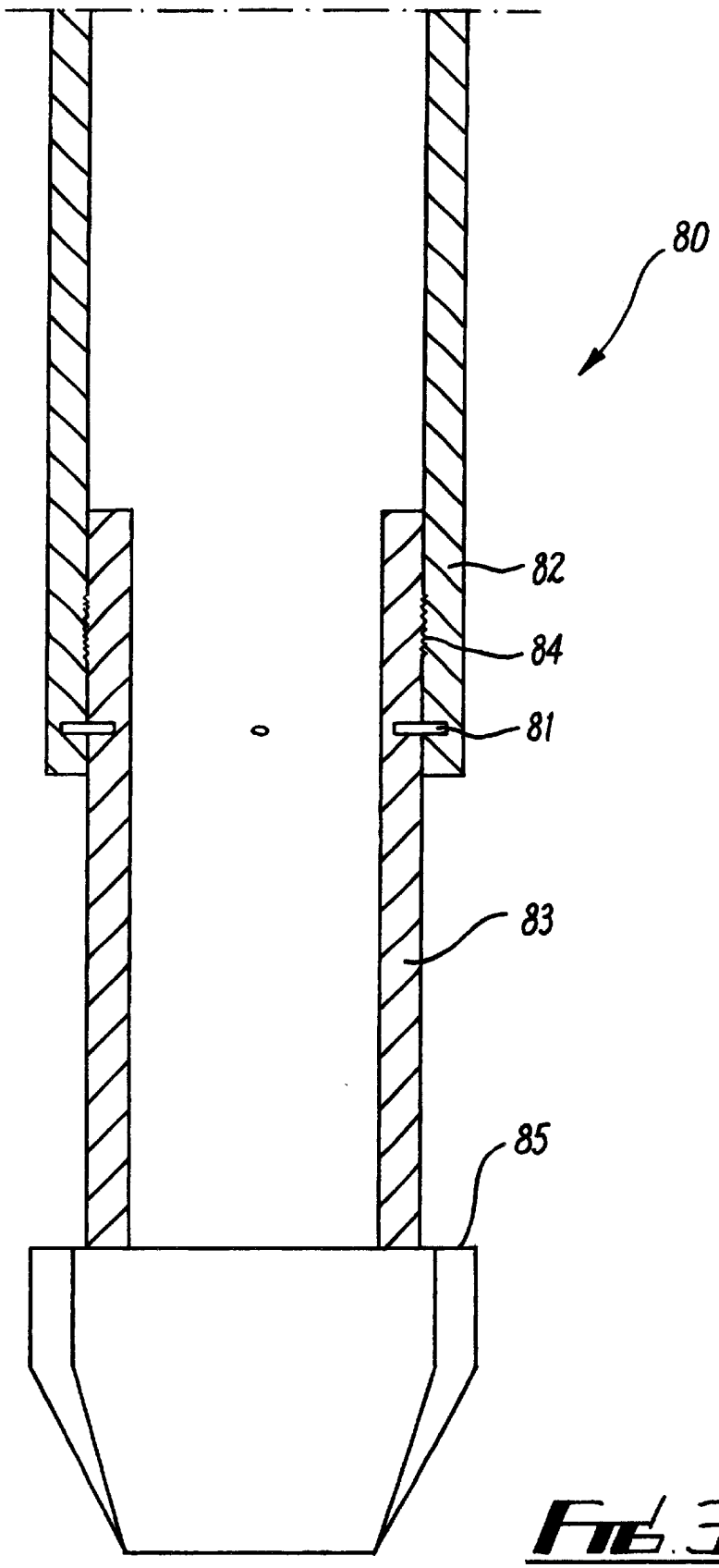
FIG. 3 in a similar view shows a yet further alternative embodiment.

The tool 80 in FIG. 3 differs from the embodiments of FIGS. 1 and 2 in that the signal means for alerting an operator to an excessive torque having been reached occurs through a weight drop.

As before, a frangible element 81 rotatable couples an upper member 82 and a lower member 83. A threaded portion 84 may be provided to assist in load bearing, thereby ensuring that the weight of the drill string below the upper member 82 is not supported solely by the pins 81.

With this embodiment, when the shear pins 81 fracture, the upper member 82, once clear of the thread 84, collapses down the tool 80 until landing on the shoulder 85. An operator can be notified of the occurrence by monitoring the weight or load of the string, and detecting a momentary weight loss while the tool 80 collapses.

Again, re-engaging means may be provided for enabling the re-engagement of the upper tubular member 82 with the lower tubular member 83 to prevent relative rotation. This may be achieved, for example, by providing a profile in the upper member 82 which corresponds with a male profile in the lower member 83, the respective profiles being mutually engagable and coming into alignment when rotational coupling is required to be re-established.

Further modifications and improvements may be incorporated without departing from the scope of the invention herein intended. For example, the re-engaging means may also be frangible or otherwise torque limiting; being adapted to shear or disengage at a predetermined and excessive torque. Alternatively, a drill string may be provided with tools in accordance with the invention provided in series thereon, wherein the tools have staged rupturing torques.

What is claimed is:

1. A down-hole tool comprising a generally tubular body through which drilling fluid flows for connection in a drill string, the body comprising an upper tubular member and a lower tubular member interconnected to be axially secured and relatively rotatable, and a frangible element securing the upper and lower members together rotationally, the frangible element being adapted to rupture at a predetermined load, and signaling means for signaling to an operator that the frangible element has been ruptured, wherein the signaling means generates a signal in the form of a change in fluid pressure.

2. A down-hole tool as claimed in claim 1 further comprising a substantially radial passage allowing for the circulation of fluid from an axial bore through the tool to the exterior of the tool when the frangible element has been ruptured.

3. A down-hole tool as claimed in claim 2, further including means for re-establishing drilling fluid flow through a drill bit provided on the drill string after the frangible element has been ruptured.

4. A down-hole tool as claimed in claim 2, wherein a lower part of the upper tubular member is of reduced diameter and is encircled by the lower tubular member, said passage being formed by radial bores in the overlapping parts of the upper and lower tubular members.

5. A down-hole tool as claimed in claim 2 having a plurality of said passages circumferentially equispaced, each having a frangible element in the form of a shear plug or pin.

6. A down-hole tool as claimed in claim 2, further including a valve member moveable between a first position permitting fluid flow through the passage to a second position obturating the passage.

7. A down-hole tool as claimed in claim 6 wherein the valve member is a cylindrical sleeve mounted in the bore of the upper tubular member for sliding movement.

8. A down-hole tool as claimed in claim 7 wherein the valve member is secured in its first position by a shear pin.

9. A down-hole tool as claimed in claim 6 wherein the valve member is adapted to be moved from the first position to the second position by a ball passed down a bore in the drill string.

10. A down-hole tool as claimed in claim 6, wherein the valve member is provided with axially spaced apertures, including upper apertures that may be aligned with the passages when the valve member is in the first position and lower apertures communicating with the bore of the lower tubular member in the second position.

11. A downhole tool as claimed in claim 1, wherein interior threads on one of the upper and lower tubular members engage exterior threads on the other of the upper and lower tubular members to axially secure the upper tubular member to the lower tubular member, and wherein when the frangible element ruptures, the upper and lower tubular members are free to rotate with respect to one another so that the upper tubular member moves axially with respect to the lower tubular member as a result of the threaded connection between the upper and lower tubular members.

12. A downhole tool as claimed in claim 11, wherein after the frangible element has ruptured, and the upper tubular member is rotated with respect to the lower tubular member, a shoulder on one of the upper and lower tubular members will contact an abutting portion on the other of the upper and lower tubular members after a predetermined amount of relative rotation has occurred such that the upper and lower tubular members are again axially secured relative to one another.

13. A downhole tool as claimed in claim 12, wherein radial passages are located in the upper and lower tubular members such the radial passages are not aligned with one another before the frangible element ruptures, and such that after the frangible element has ruptured and the upper and lower tubular members have rotated with respect to one another sufficiently for the shoulder to contact the abutting portion, the radial passages in the upper tubular member align with the radial passages in the lower tubular member.

* * * * *